US008336473B2

(12) United States Patent
Nemec et al.

(10) Patent No.: US 8,336,473 B2
(45) Date of Patent: Dec. 25, 2012

(54) MATTRESS EDGE SEWING MACHINE

(75) Inventors: Stanislav Nemec, Ludbreg (HR); Stjepan Vadlja, Cakovec (HR)

(73) Assignee: L & P Property Management Company, South Gate, CA (US)

( * ) Notice: Subject to any disclaimer, the term of this patent is extended or adjusted under 35 U.S.C. 154(b) by 170 days.

(21) Appl. No.: 12/776,996

(22) Filed: May 10, 2010

(65) Prior Publication Data

US 2010/0282148 A1 Nov. 11, 2010

Related U.S. Application Data

(60) Provisional application No. 61/177,128, filed on May 11, 2009.

(51) Int. Cl.
*D05B 11/00* (2006.01)

(52) U.S. Cl. ..... 112/2.1

(58) Field of Classification Search ..... 112/2.1, 112/2.2, 136, 148, 150, 152, 153, 235, 217.1, 112/470.36, 304, 306, 308, 309, 311, 320, 112/470.05, 470.14, 470.27

See application file for complete search history.

(56) References Cited

U.S. PATENT DOCUMENTS

| | | | |
|---|---|---|---|
| 1,603,307 | A | 10/1926 | Anderson |
| 4,063,632 | A | 12/1977 | Neth et al. |
| 4,229,136 | A | 10/1980 | Panissidi |
| 4,958,579 | A | 9/1990 | De Weers |
| 5,216,969 | A | 6/1993 | Thomas et al. |
| 5,483,909 | A | 1/1996 | Nogueras |
| 5,515,796 | A | 5/1996 | Ogle et al. |

OTHER PUBLICATIONS

PCT Notification of Transmittal of the International Search Report and the Written Opinion of the International Searching Authority mailed Jul. 9, 2010 for PCT/US2010/034364, 11 pages.

*Primary Examiner* — Tejash Patel
(74) *Attorney, Agent, or Firm* — Shook, Hardy & Bacon L.L.P.

(57) ABSTRACT

A mattress edge tape machine is provided. More specifically, a workstation for applying a tape edge material about the peripheral side edges of bedding materials such as mattresses or foundation sets is provided. The mattress edge tape machine has a table adapted to support a work piece, at least one conveyor belt coupled to the table, a sewing head mounted directly adjacent to the table for performing a sewing operation on the work piece, and an arcuate turning arm mounted adjacent to the table to selectively turn the work piece on the table. The arcuate arm may include a clamping device for moving and securing the work piece. The machine may also include a guide assembly of actuators, instead of an arcuate turning arm.

20 Claims, 11 Drawing Sheets

MATTRESS EDGE SEWING MACHINE

CROSS-REFERENCE TO RELATED APPLICATIONS

This application claims the benefit of U.S. Application 61/177,128, filed May 11, 2009, which is hereby incorporated by reference.

STATEMENT REGARDING FEDERALLY SPONSORED RESEARCH OR DEVELOPMENT

Not applicable.

TECHNICAL FIELD

The present invention generally relates to automated sewing machinery. More particularly, the invention relates to an automated sewing station for sewing a tape edge to the outer edges of a large article, such as a mattress.

BACKGROUND OF THE INVENTION

In the manufacture of large bedding materials, the edges of the materials must be sewn together. As an example, both the top and bottom edges of mattresses must be sewn together. This involves sewing the side panels of the mattress to the top and bottom panels respectively. Specialized edge sewing and taping machines are used to accomplish this sewing, and are commonly known as tape edge machines.

One form of these tape edge machines moves the mattress in relation to a stationary sewing head. Using these machines, the mattress will be placed on a table. The table supports the mattress. A tape edge applicator and sewing head are positioned immediately adjacent the table. The table is equipped to move the mattress in relation to the tape edge applicator and sewing head. Upon completion of a sewing operation on one side of the mattress, the table is equipped to turn the mattress over, such that the other side of the mattress can be completed.

One problem with current tape edge machines involves the area around the sewing head. To properly complete the sewing process, an operator of the machine needs access to the area around the sewing head. On existing tape edge machines, an arm is fixed to a pivot point near the top of the table. The arm can pivot about 90 degrees, so that the mattress can be turned as one side of the mattress is sewn, so that the next side can be sewn. When one side of the mattress is completed, the arm pivots about the pivot point to rotate the mattress so the next side can be sewn. One problem with this construction is that the fixed pivot point is typically in the area of the sewing head, and provides less room for the operator of the machine in that area.

Another benefit to freeing space about the sewing head, through removal of a physical pivot, is the ability to process and sew mattresses of very low heights. The presence of a physical pivot places a limit on the point to which the sewing head can be lowered. In turn, this results in the ability to sew only those mattresses that are above a certain height.

Another problem with current tape edge machines involves the flipping of the mattress. In current tape edge machines, typically one or two narrow arms are provided on the table. When the top of the mattress has been sewn along the entire edge, it must be flipped over, so the bottom can be similarly sewn. It is desirable to properly position the mattress after it is flipped. The current approach does not consistently position the mattress upon flipping. This is especially true of the more flexible mattresses, such as those made with greater amounts of foam materials.

Accordingly, a need exists for a tape edge machine for bedding components such as mattresses and foundation sets, which addresses the foregoing and other problems.

BRIEF SUMMARY OF THE INVENTION

The present invention generally relates to a workstation for applying a tape edge material about the peripheral side edges of bedding materials such as mattresses or foundation sets. Throughout the remainder of this application, reference will be made to a mattress. It should be understood that the invention contemplates other types of components, both bedding and otherwise, and that the invention is not limited to the specific component being operated on. The tape edge machine has a table divided into a forward and a rearward section. Each section has a pair of conveyor belts that operate to move a mattress in relation to an adjacent sewing head. The rearward section is equipped with a flipper board, positioned generally in the center of the table, from front to back. The tape edge machine further includes a pedestal on which the sewing head is mounted. Also mounted to the pedestal is a mattress-turning station. The mattress turning station has a novel construction that opens space around the sewing head to allow operator access to this area.

Additional objects, advantages, and novel features of the invention will be set forth in part in the description which follows, and in part will become apparent to those skilled in the art upon examination of the following, or may be learned by practice of the invention.

BRIEF DESCRIPTION OF THE SEVERAL VIEWS OF THE DRAWING

The present invention is described in detail below with reference to the attached drawing figures, wherein.

DETAILED DESCRIPTION OF THE INVENTION

Figure 1:
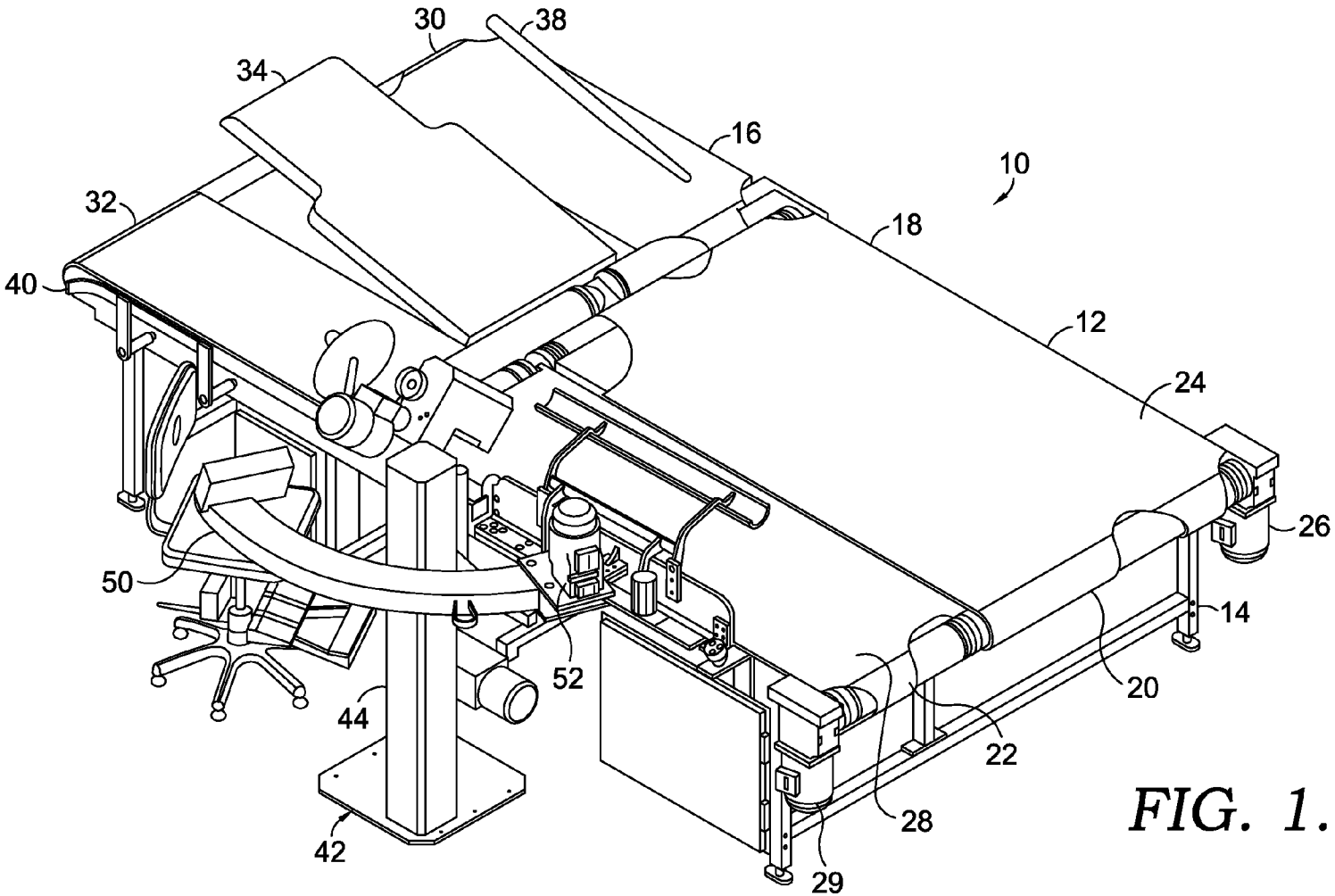
FIG. 1 is a perspective view of one embodiment of the tape edge machine.
Figure 2:
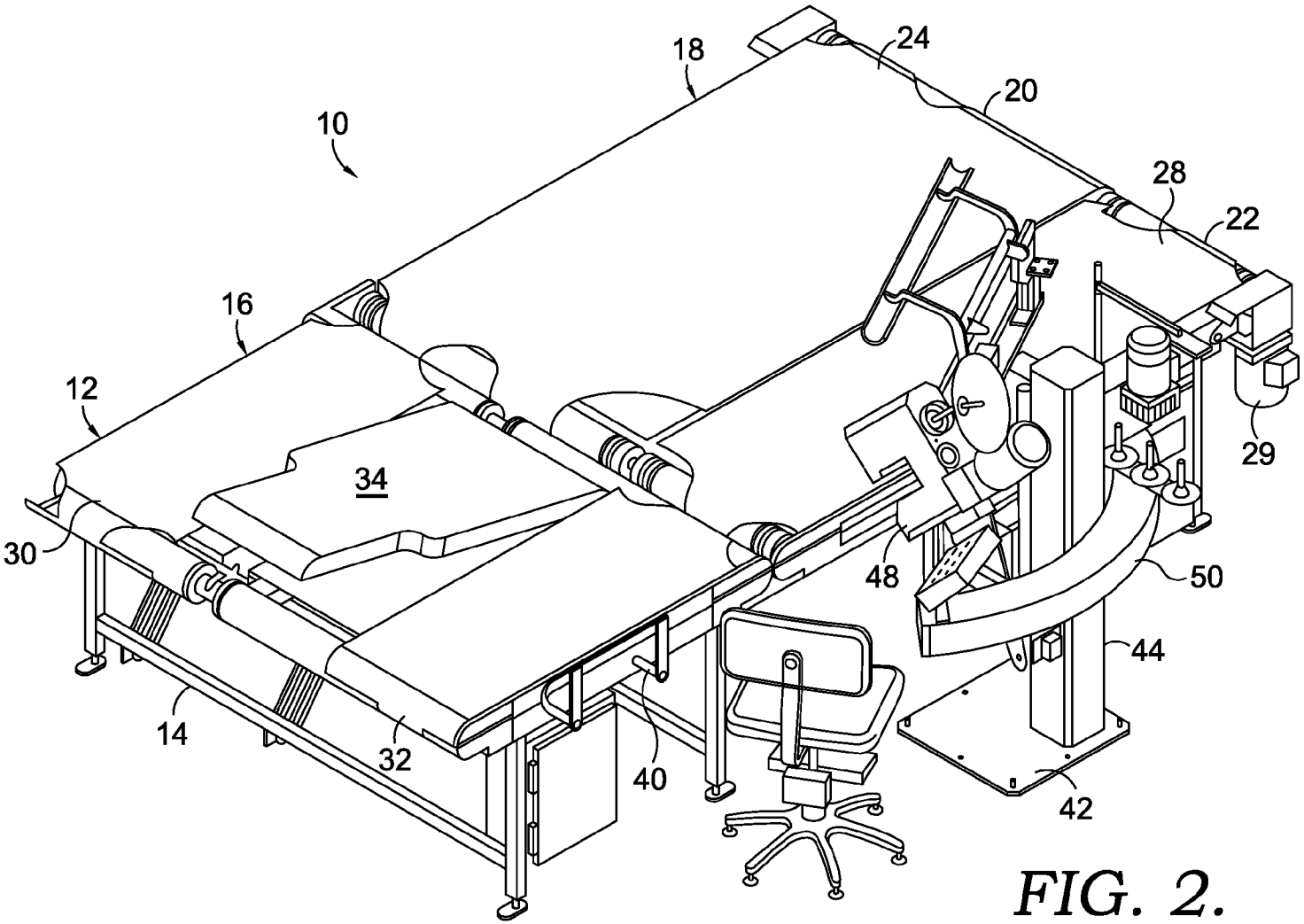
FIG. 2 is a perspective view, similar to FIG. 1, but from a different point of view.
Figure 3:
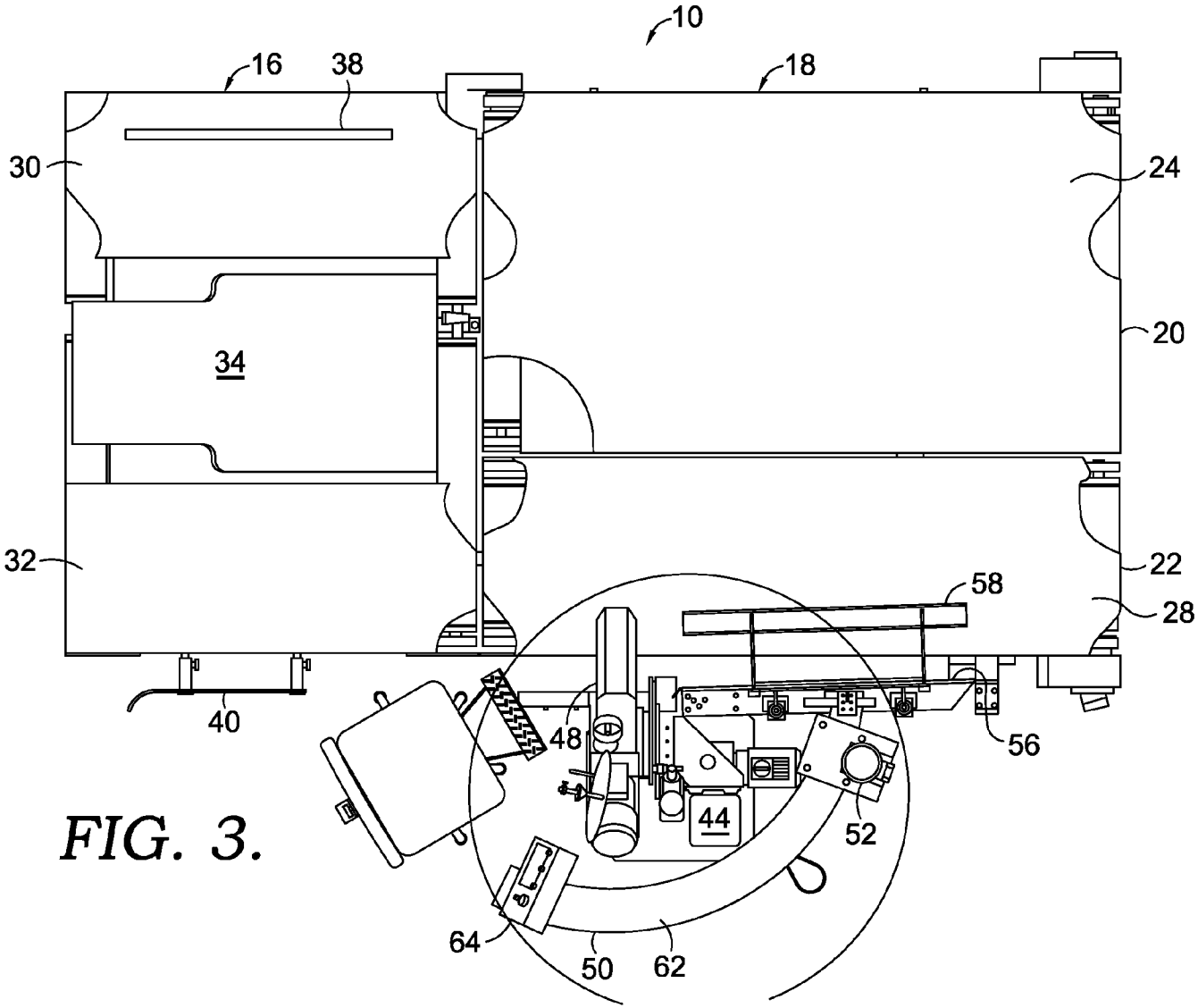
FIG. 3 is a top view.
Figure 4:
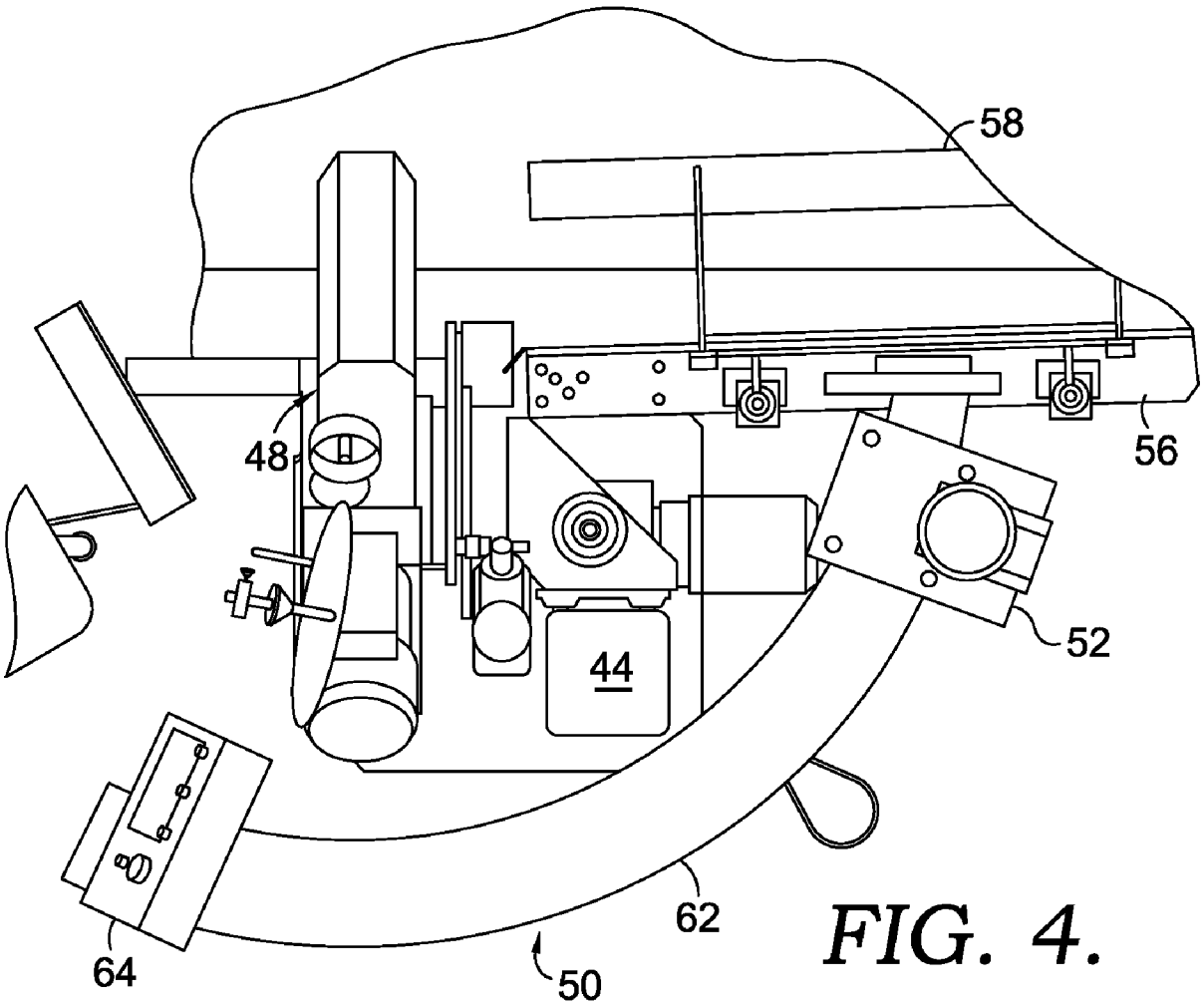
FIG. 4 is a partial, enlarged view of the encircled region of FIG. 3.

A first embodiment of a tape edge machine 10 is seen in FIGS. 1-7. Tape edge machine 10 includes a table 12, supported by a base structure 14. The table 12 has a rear section 16 and a forward section 18. Forward section 18 is divided into two sections 20 and 22. Section 20 is equipped with a conveyor belt 24, driven by a motor 26. Similarly, section 22 is equipped with a conveyor belt 28, driven by a motor 29. The movement of the belts 24 and 28 is controlled and coordinated by a programmable controller. The same programmable controller may be used to control the other belts and motors described below.

Figure 5:
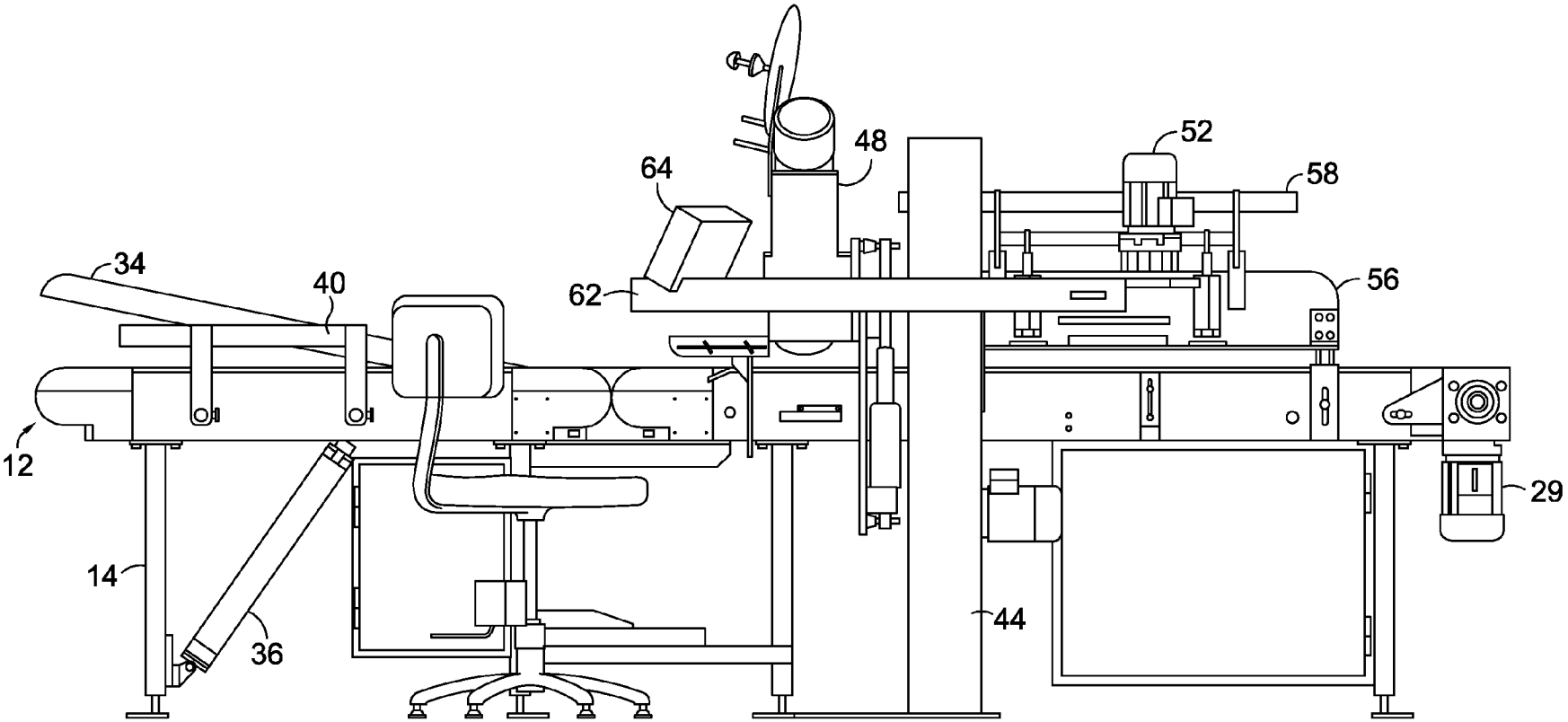
FIG. 5 is a front elevation view.

The rear section 16 is also equipped with two conveyor belts, labeled 30 and 32. A flipping arm 34 separates these two belts. Arm 34 has a substantial width, which is preferably around one-third the total width of the table 12. Arm 34 is pivotably connected to the rear section 16, and is attached to a drive mechanism 36. Drive mechanism 36 can pivot arm 34 upwardly when desired, and can be any of a number of devices such as a pneumatic cylinder or linear drive mechanism. Arm 34 is used to turn a work piece over when desired so that the opposite side of the work piece can be sewn. Rear section 16 may also be equipped with a pivoting guide arm 38 spaced from arm 36. A stationary guide 40 is also provided along a side of the rear section 16, as best seen in FIG. 5.

The table 12 and the conveyor belts on sections 16 and 18 are used to support and move a work piece. For example, a mattress can be placed on the table 12. As described more fully below, the table 12 and conveyor belts operate to maneuver the mattress so it is properly positioned relative to a sewing head.

Figure 7:
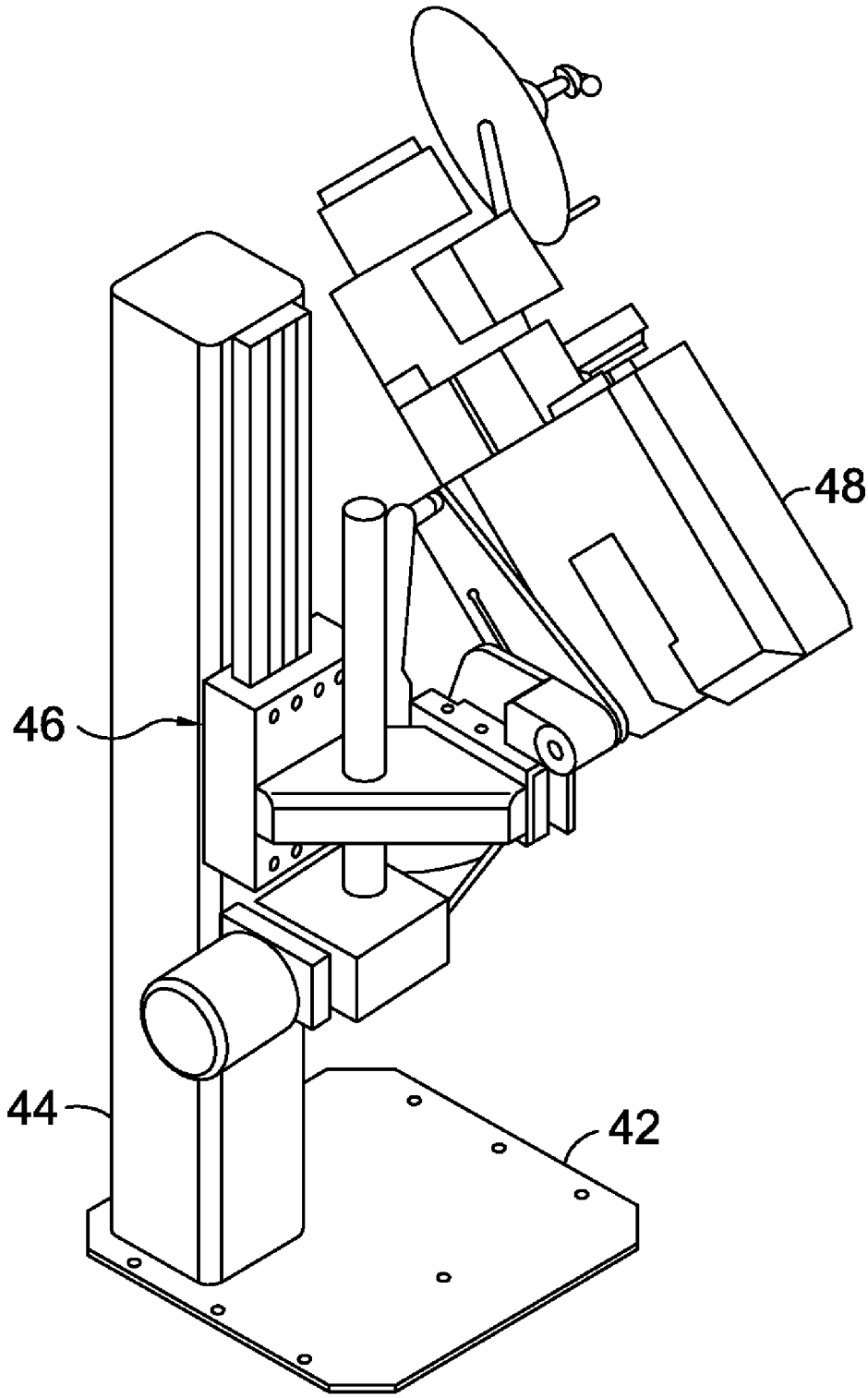
FIG. 7 is a perspective view of the pedestal and sewing head.
Figure 8:
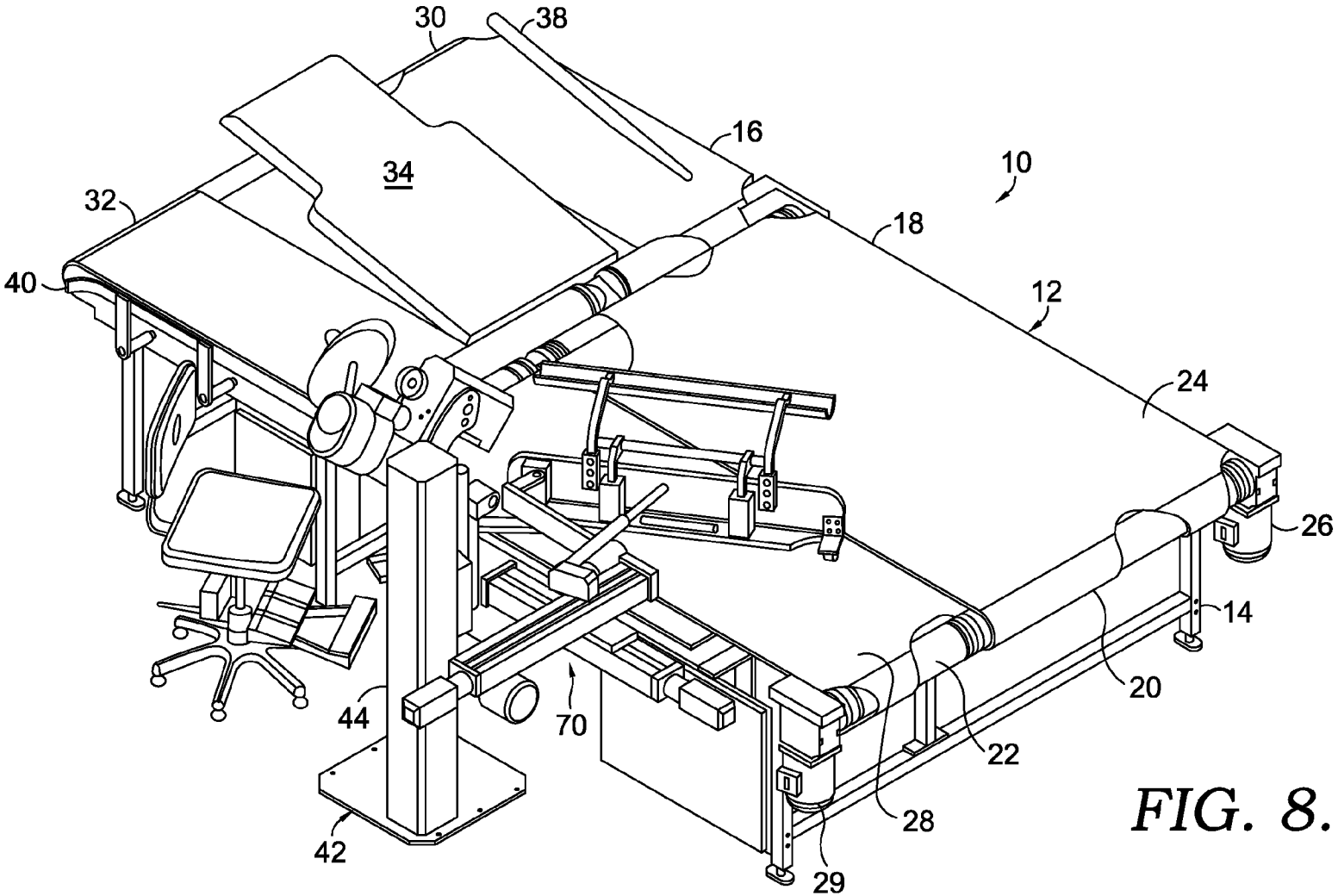
FIG. 8 is a perspective view of another embodiment of the tape edge machine.
Figure 9:
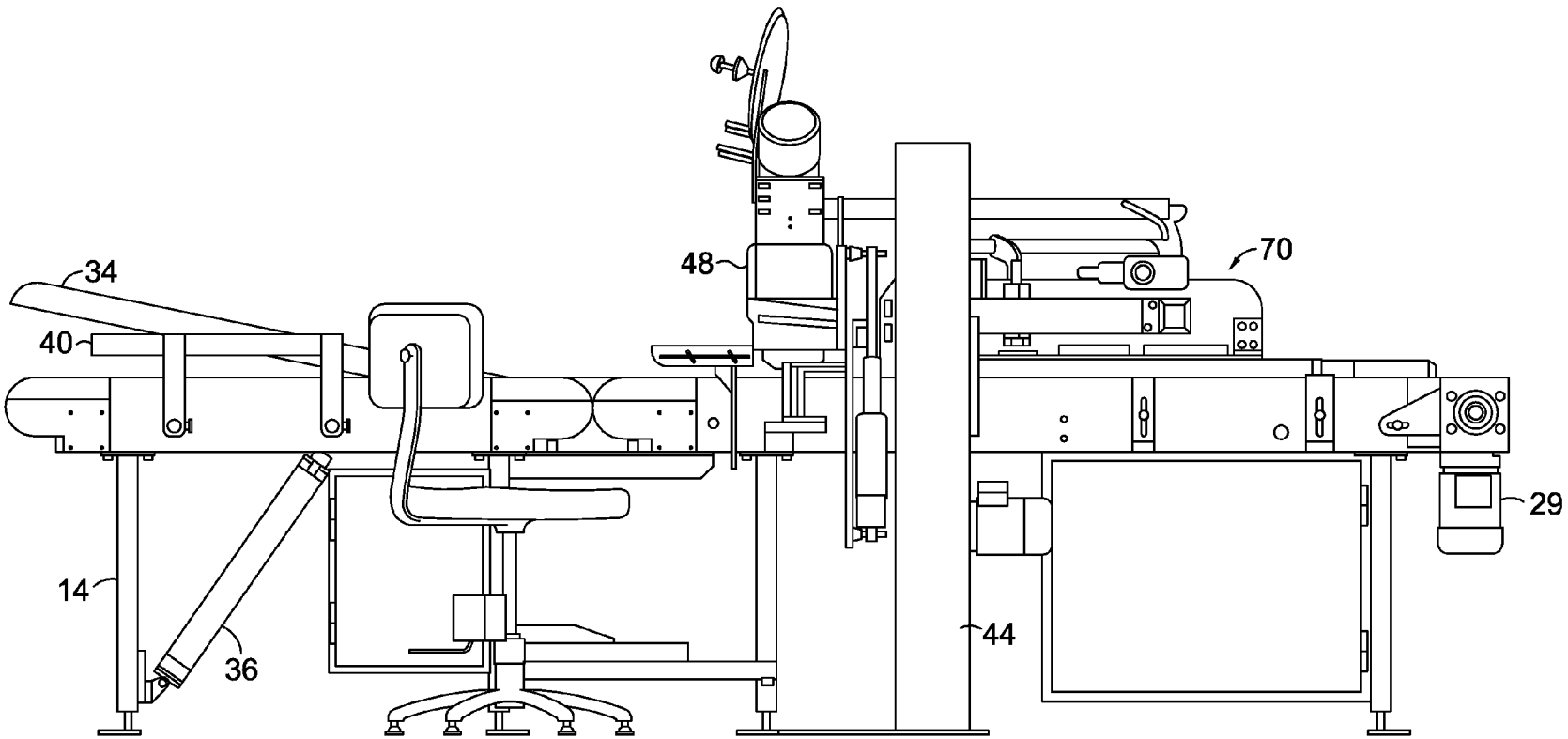
FIG. 9 is a front elevation view of the embodiment of FIG. 8.

A pedestal 42 is mounted adjacent table 12. Pedestal 42 has a main column 44, equipped with a linear guide 46. Guide 46, as best seen in FIG. 7, is motor-driven and is used to moveably mount a sewing head 48 to the pedestal 42. Using guide 46, the sewing head can be positioned vertically relative to the work piece for sewing, or can be moved upwardly to move the sewing head out of the way. Sewing head 48 can be any of a number of commercially available sewing heads, equipped to sew a tape edge to the work piece.

Figure 6:
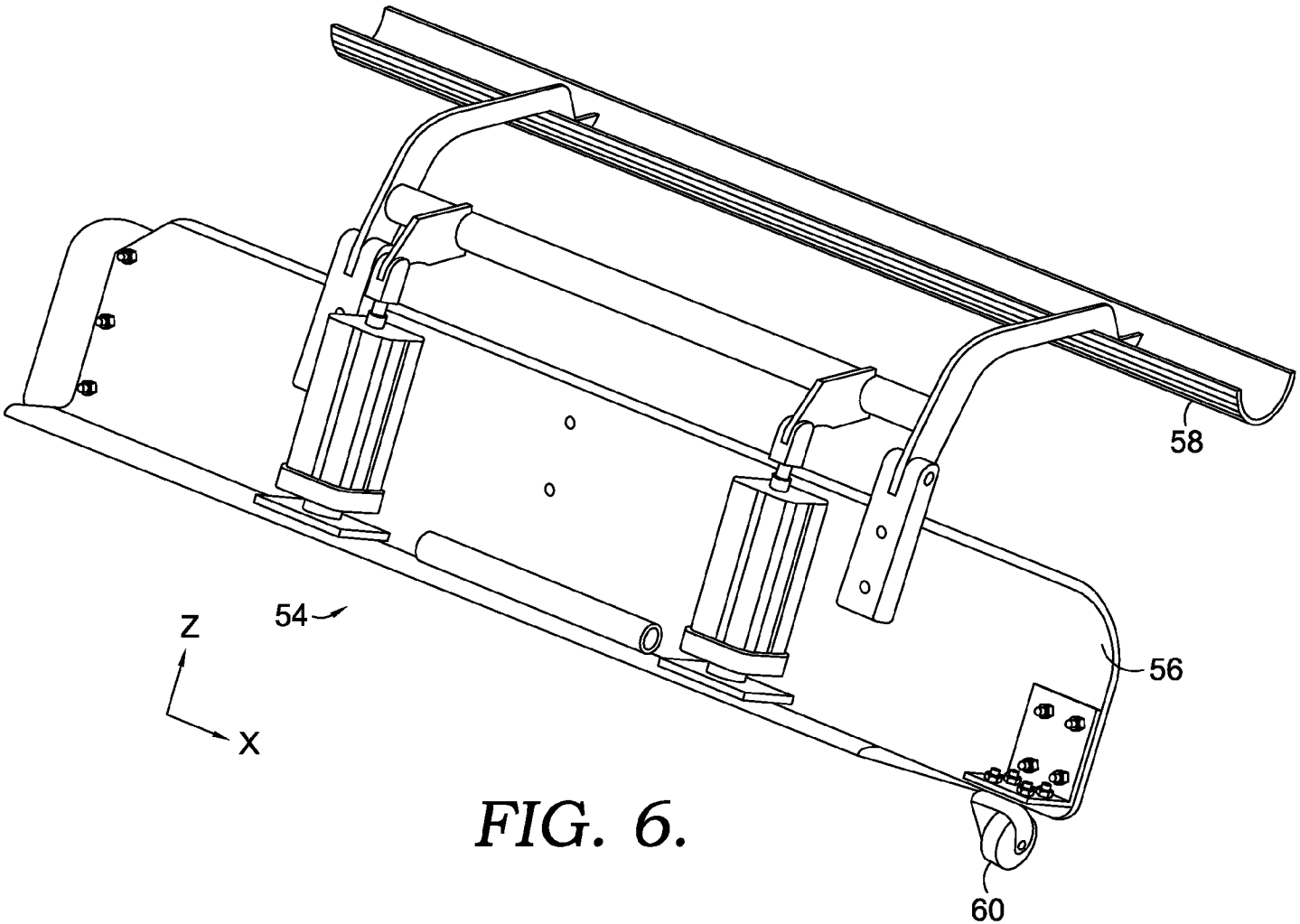
FIG. 6 is a perspective view of the clamping assembly.

An arcuate turning arm 50 is mounted to the pedestal, as best seen in FIGS. 1-4. The arcuate turning arm 50 replaces the traditional stationary pivoting arm of current tape machines. The turning arm 50 is driven by a motor 52, and can be driven by gears, belts or other means. Turning arm 50 is coupled to a clamping device 54. Clamping device 54 is best seen in FIG. 6. Device 54 has a pushing arm 56 and a pivoting clamping arm 58. Pushing arm 56 is driven by the turning arm 50 and operates to turn a work piece approximately ninety degrees, when desired. Clamping arm 58 operates to secure the work piece for the movement. For example, when one edge of a mattress is sewn, the arm 50 can be extended, driven by motor 52. Pushing arm 56 operates to rotate the mattress ninety degrees. The clamping arm 58 operates to secure the mattress to control this movement. As best seen in FIG. 6, the pushing arm 56 may be equipped with a support caster 60 that rolls on the surface of table 12 during the movement. After turning, the device 54 is returned, and the sewing operation on the next edge of the mattress continues.

Turning arm 50 is preferably covered with a guard 62. This guard 62 also serves as a mounting and support surface for a control panel 64. The panel 64 is usable by the operator of tape edge machine 10 to control and operate the machine. For example, the panel 64 can be equipped with controls to activate the machine, stop the machine, raise and lower the sewing head, etc.

In use, the machine 10 can sew a tape edge to a work piece, such as a mattress. The conveyor belts are used and controlled to properly position the mattress relative to the sewing head. After a first edge of the mattress is sewn, the turning arm is used to rotate the mattress ninety degrees, so the next edge may be sewn. After all four edges have been sewn, the conveyor belts and the flipping arm (using drive mechanism 36) are used to flip the mattress, enabling the other side of the mattress to be sewn in a similar manner. The use of the arcuate turning arm in place of a stationary physical pivot frees the area surrounding the sewing head at the point of sewing, making the operation of the machine easier for the operator. The use of the wider flipping arm enables a greater variety of work pieces to be turned, such as those more flexible pieces made from foam or a similarly flexible material.

Figure 10:
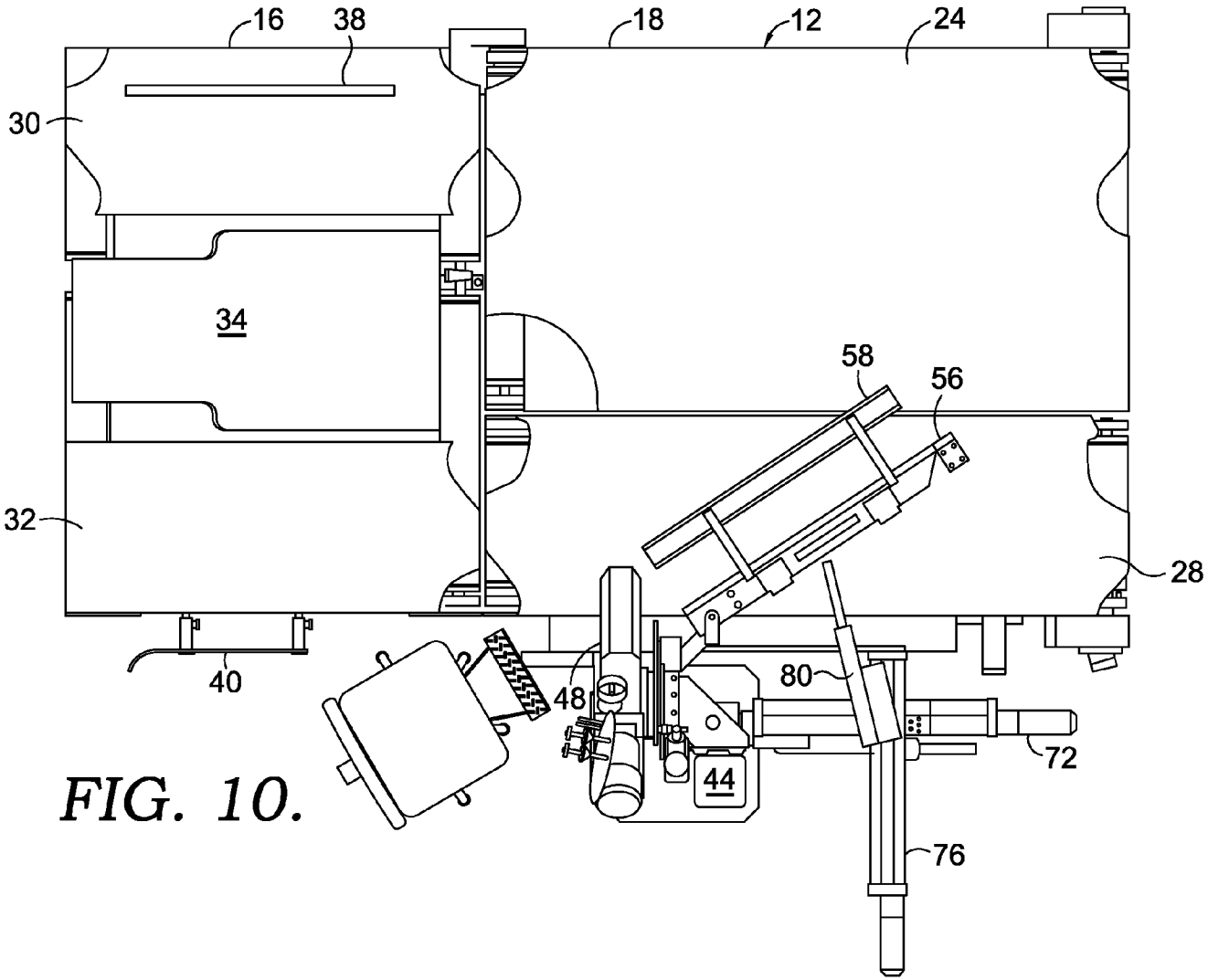
FIG. 10 is a top view of the embodiment of FIG. 8.
Figure 11:
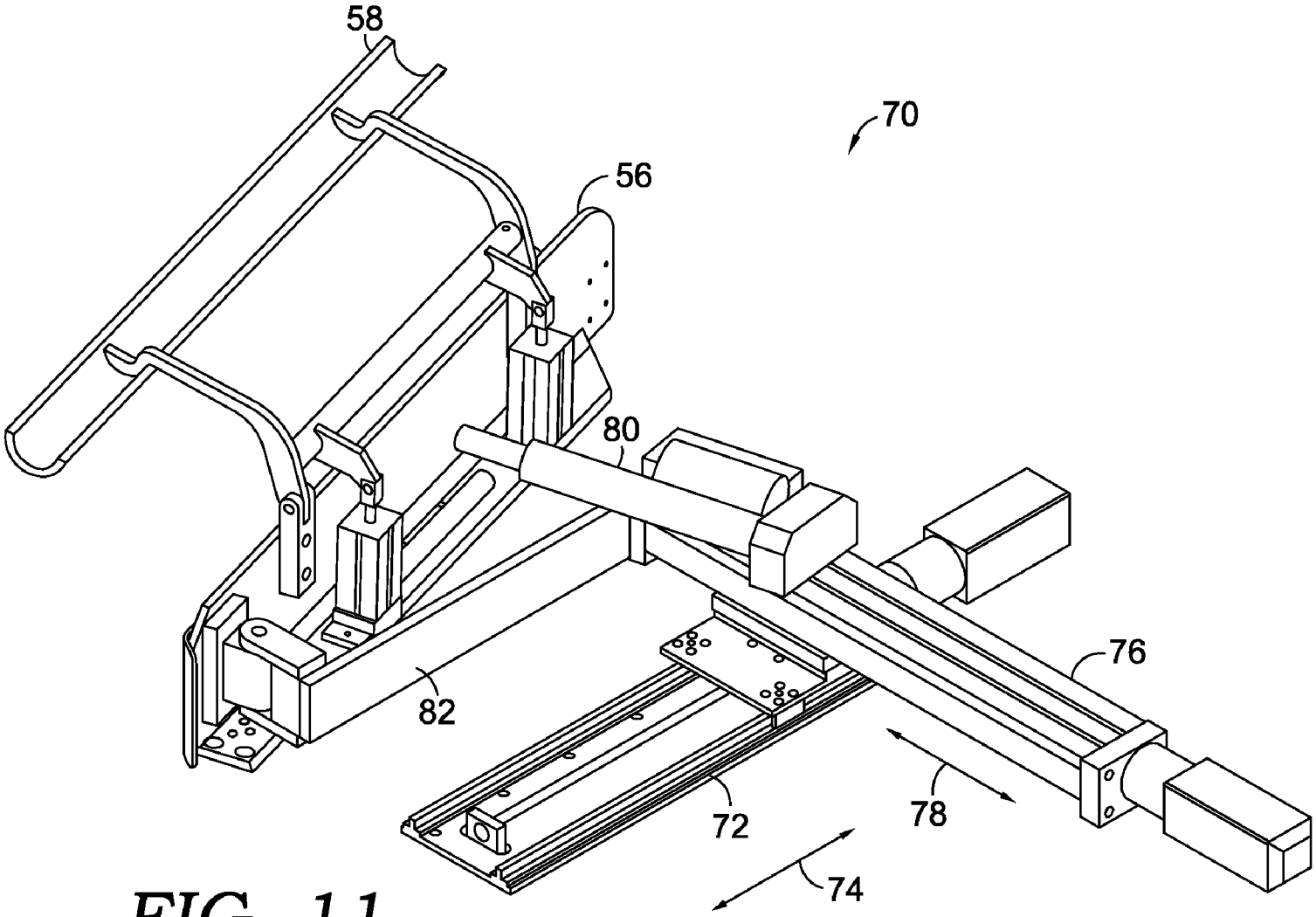
FIG. 11 is a perspective view of the turning assembly of the embodiment of FIG. 8.

Another embodiment of the invention is seen in FIGS. 8-11. This embodiment differs in that arcuate turning arm 50 is replaced with a guide assembly 70. Guide assembly 70 is mounted to the pedestal 42. As best seen in FIGS. 10 and 11, guide assembly 70 has three actuators. A first actuator 72 is moveable in the direction of arrow 74 in FIG. 11. A second actuator 76 is moveable in the direction of arrow 78 in FIG. 11 (perpendicular to first actuator 72). A third actuator 80 is coupled to the pushing arm 56, which is pivotably coupled to the frame of actuator 76 though link arm 82. This three actuator assembly is also used to turn the work piece ninety degrees at appropriate times. Like the arcuate arm 50, this embodiment also eliminates the need for a physical pivot point near the point of sewing.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

The invention claimed is:

1. A mattress edge tape machine, comprising:

a table that supports a work piece;

at least one conveyor belt coupled to the table that selectively moves the work piece;

a sewing head mounted directly adjacent the table at a first location, wherein the sewing head performs a sewing operation on the work piece; and an arcuate arm mounted adjacent the table, wherein the arcuate arm selectively turns the work piece on the table, and further wherein a pivot point for the work piece during turning by the arcuate arm is at a second location that is distinct from the first location such that the pivot point is distinct from an area surrounding the sewing head at a point of sewing, and further wherein the pivot point is substantially spaced from an edge of the table.

2. The machine of claim 1, further comprising:

at least one flipping arm pivotably coupled to the table, wherein the at least one flipping arm pivots upward to turn the work piece.

3. The machine of claim 1, further comprising:

at least one guide arm pivotably coupled to the table, wherein the at least one guide arm guides the work piece.

4. The machine of claim 1, further comprising:

at least one stationary guide coupled to the table, wherein the at least one stationary guide guides the work piece.

5. The machine of claim 1, wherein the arcuate arm is coupled to a clamping device, wherein the clamping device selectively turns the work piece.

6. The machine of claim 5, wherein the clamping device comprises a pushing arm coupled to the clamping device, wherein the pushing arm turns the work piece.

7. The machine of claim 6, wherein the pushing arm turns the work piece from a first position to a second position perpendicular to the first position.

8. The machine of claim 6, wherein the pushing arm is coupled to at least one support caster that rolls on the surface of the table.

9. The machine of claim 6, wherein the clamping device further comprises a pivoting clamping arm coupled to the clamping device, wherein the pivoting clamping arm secures the work piece during movement.

10. A mattress edge taping machine, comprising:

a table adapted to support a work piece;

at least one conveyor belt coupled to the table that selectively moves the work piece;

a sewing head mounted directly adjacent the table at a first location, wherein the sewing head performs a sewing operation on the work piece; and a guide assembly mounted adjacent the table, wherein the guide assembly selectively turns the work piece on the table, and further wherein a pivot point for the work piece during turning by the guide assembly is at a second location that is distinct from the first location such that the pivot point is distinct from an area surrounding the sewing head at a point of sewing.

11. The machine of claim 10, wherein the guide assembly comprises a plurality of actuators, wherein the plurality of actuators selectively turn the work piece.

12. The machine of claim 11, wherein the guide assembly comprises:

a first actuator;

a second actuator coupled to the first actuator, the second actuator moveable in a perpendicular direction to the first actuator;

a third actuator coupled to the second actuator; and a clamping device coupled to the third actuator, wherein the clamping device selectively turns the work piece.

13. The machine of claim 12, wherein the clamping device comprises a pushing arm coupled to the clamping device, the pushing arm pivotably coupled to the second actuator by a link arm.

14. The machine of claim 13, wherein the pushing arm turns the work piece from a first position to a second position perpendicular to the first position.

15. The machine of claim 13, wherein the pushing arm is coupled to at least one support caster that rolls on the surface of the table.

16. The machine of claim 13, wherein the clamping device further comprises a pivoting clamping arm coupled to the clamping device, the pivoting clamping arm secures the work piece during movement.

17. A mattress edge taping machine, comprising:

a table adapted to support a work piece;

at least one conveyor belt coupled to the table, wherein the at least one conveyor belt selectively moves the work piece;

a sewing head mounted directly adjacent the table at a first location, wherein the sewing head performs a sewing operation on the work piece;

a moveable turning device mounted adjacent the table, wherein the turning device turns the work piece on the table, and further wherein a pivot point for the work piece during turning by the turning device is at a second location that is distinct from the first location such that the pivot point is distinct from an area surrounding the sewing head at a point of sewing; and a clamping device coupled to the moveable turning device, wherein the clamping device selectively turns the work piece from a first position to a second position perpendicular to the first position.

18. The machine of claim 17, wherein the clamping device comprises:

a pushing arm coupled to the clamping device, wherein the pushing arm turns the work piece; and a pivoting clamping arm coupled to the clamping device, wherein the pivoting clamping arm secures the work piece during movement.

19. The machine of claim 18, wherein the moveable turning device is an arcuate arm that selectively turns the work piece on the table.

20. The machine of claim 18, wherein the moveable turning device comprises:

a first actuator;

a second actuator coupled to the first actuator, the second actuator moveable in a perpendicular direction to the first actuator, wherein the second actuator is pivotably coupled to the clamping device by a link arm; and a third actuator coupled to the second actuator, wherein the third actuator is further coupled to the clamping device.

* * * * *